US010663895B1

(12) United States Patent
Takahashi

(10) Patent No.: US 10,663,895 B1
(45) Date of Patent: May 26, 2020

(54) IMAGE FORMING APPARATUS AND IMAGE FORMING METHOD WITH TEMPERATURE CONTROL

(71) Applicant: TOSHIBA TEC KABUSHIKI KAISHA, Shinagawa-ku, Tokyo (JP)

(72) Inventor: Koji Takahashi, Sumida Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/255,310

(22) Filed: Jan. 23, 2019

(51) Int. Cl.
*G03G 15/20* (2006.01)
*G03G 15/01* (2006.01)

(52) U.S. Cl.
CPC ..... *G03G 15/2039* (2013.01); *G03G 15/01* (2013.01)

(58) Field of Classification Search
CPC . G03G 15/2039; G03G 15/01; G03G 15/6585
See application file for complete search history.

(56) References Cited

U.S. PATENT DOCUMENTS 5,394,231 A 2/1995 Sudo et al.
9,952,548 B2 4/2018 Ueno
2011/0311249 A1* 12/2011 Kubota ..... G03G 15/2017 399/44
2016/0026108 A1* 1/2016 Ikuta ..... G03G 15/0121 399/223

* cited by examiner

*Primary Examiner* — Sandra Brase
(74) *Attorney, Agent, or Firm* — Foley & Lardner LLP

(57) ABSTRACT

According to one embodiment, an image forming apparatus includes a fixing roller, a heater, a heater controller, and a roller controller. The fixing roller conveys a sheet by rotation and fixes a recording material formed on the sheet to the sheet. The heater heats the fixing roller. The heater controller controls a temperature of the heater. The roller controller controls a rotation speed of the fixing roller. When the roller controller satisfies a predetermined condition indicating that a fixing part temperature indicating a temperature of the fixing roller is not suitable for operation, the roller controller increases a rotation speed to be higher than a rotation speed of a case in which the predetermined condition is not satisfied.

18 Claims, 7 Drawing Sheets

IMAGE FORMING APPARATUS AND IMAGE FORMING METHOD WITH TEMPERATURE CONTROL

FIELD

Embodiments described herein relate generally to an image forming apparatus and an image forming method.

BACKGROUND

An MFP (Multifunction Peripheral) forms an image by transferring a visible image onto a sheet. The visible image is formed by using a recording material such as a toner.

The recording material includes a decolorizing recording material (hereinafter referred to as a decolorizing toner), the color of which disappears by heating. A sheet on which an image is formed by the decolorizing toner is heated to a predetermined temperature (hereinafter referred to as a decolorizing temperature), whereby the toner is decolorized and the sheet can be reused.

An image forming apparatus has a function of decolorizing a decolorizing toner. In printing using a normal toner (hereinafter referred to as normal printing), a temperature of a fixing part is set to be higher than that of printing using the decolorizing toner (hereinafter referred to as decolorizing printing). In order to decolorize the decolorizing toner, it is required to set the temperature of the fixing part higher than the temperature of the printing using the normal toner.

Therefore, when the decolorizing printing is performed after the normal printing and decolorizing processing, the decolorizing printing cannot be executed until a temperature drops to a predetermined fixing temperature (e.g., the temperature needed for fixing the toner onto the print medium) so as to prevent an image to be printed from being decolorized. Accordingly, a long period of waiting time is needed until the temperature drops to the predetermined fixing temperature.

Further, each of the operations of normal printing, decolorizing processing, and decolorizing printing cannot be executed until the temperature rises to a predetermined fixing temperature. Therefore, the waiting time until the temperature rises to the predetermined fixing temperature can be long. The above-mentioned problems are not limited to the decolorizing printing. The problems are common to various processes when the fixing temperature is different and requires change.

DETAILED DESCRIPTION

An exemplary embodiment provides an image forming apparatus capable of reducing a waiting time until a fixing part reaches a predetermined temperature.

In general, according to one embodiment, an image forming apparatus includes a fixing roller, a heater, a heater controller, and a roller controller. The fixing roller conveys a sheet by rotation and fixes a recording material formed on the sheet to the sheet. The heater heats the fixing roller. The heater controller controls a temperature of the heater. The roller controller controls a rotation speed of the fixing roller. When a fixing part temperature indicating a temperature of the fixing roller satisfies a predetermined condition indicating not to be suitable for operation, the roller controller increases a rotation speed to be higher than a rotation speed in a case in which the fixing part temperature does not satisfy the predetermined condition.

Hereinafter, an image forming apparatus and an image forming method according to an exemplary embodiment will now be described with reference to the drawings.

Figure 1:
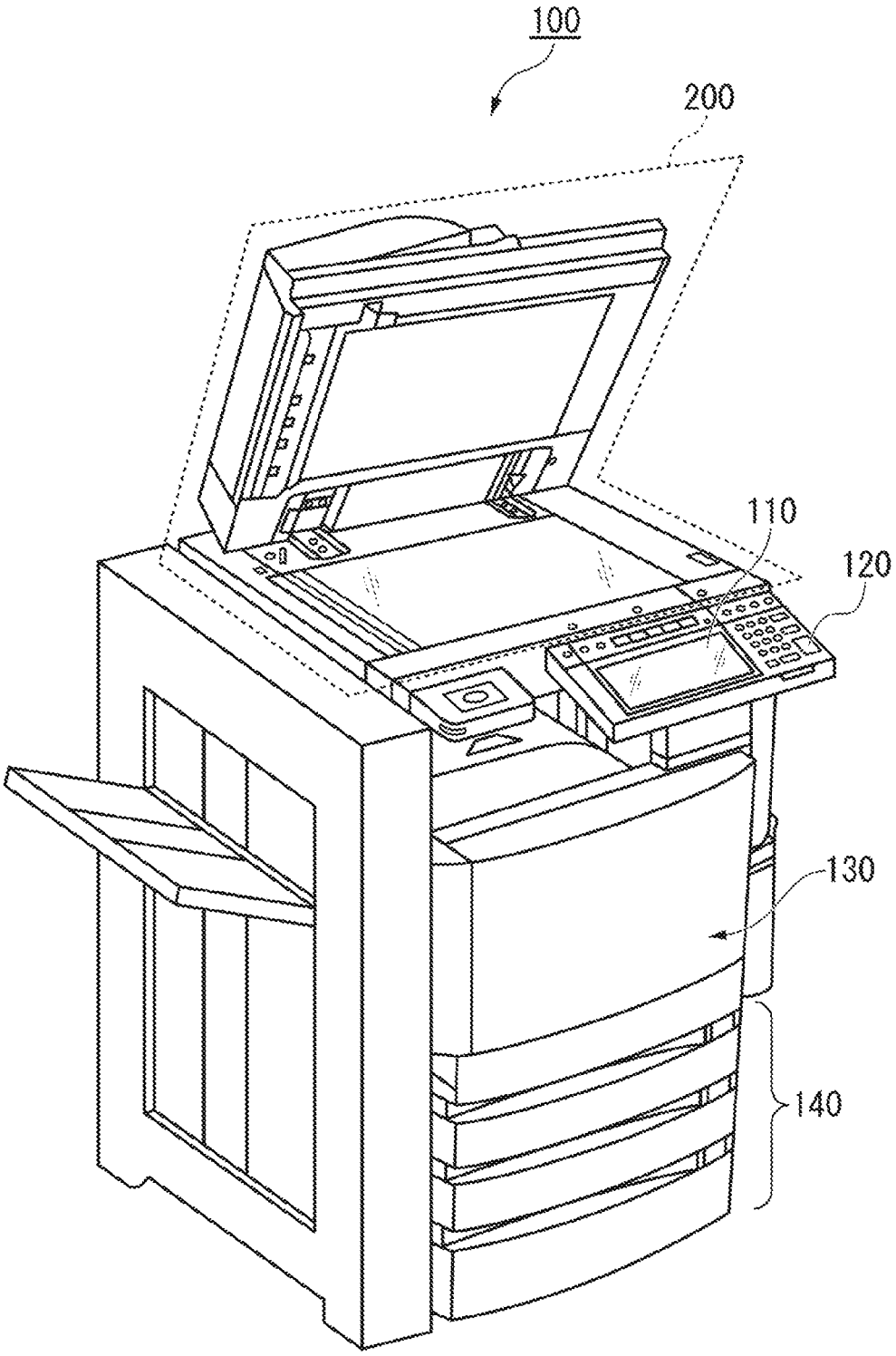
FIG. 1 is an external diagram illustrating an overall configuration example of an image forming apparatus.

FIG. 1 is an external diagram illustrating an overall configuration example of an image forming apparatus 100 according to an exemplary embodiment. The image forming apparatus 100 is, for example, a multifunction machine. The image forming apparatus 100 includes a display 110, a control panel 120, a printer 130, a sheet storage part 140, and an image reading part 200. The printer 130 of the image forming apparatus 100 may be an apparatus for fixing a toner image or an ink jet type apparatus.

The image forming apparatus 100 forms an image on a sheet by using a developer such as a toner, and the like. The sheet is, for example, paper or label paper. The sheet may be any object on the surface of which the image forming apparatus 100 can form an image.

The display 110 is an image display apparatus such as a liquid crystal display, an organic EL (Electro Luminescence) display, and the like. The display 110 displays various types of information in connection with the image forming apparatus 100.

The control panel 120 has a plurality of buttons. The control panel 120 receives operation of a user. The control panel 120 outputs a signal corresponding to the operation performed by the user to a controller of the image forming apparatus 100. Further, the display 110 and the control panel 120 may be configured as an integrated touch panel.

The printer 130 forms an image on a sheet based upon image information generated by the image reading part 200 or image information received through a communication path. The printer 130 forms an image by, for example, processes as described hereinafter. An image forming part of the printer 130 forms an electrostatic latent image on a photoconductive drum based upon the image information. The image forming part of the printer 130 forms a visible image by attaching a developer to the electrostatic latent image. A toner is a specific example of the developer. A transfer part of the printer 130 transfers the visible image onto the sheet. A fixing part of the printer 130 fixes the visible image on the sheet by heating and pressurizing the sheet. Further, the sheet on which the image is formed may be a sheet stored in the sheet storage part 140 or a sheet handled by a hand.

As examples of the toner, there exist a decolorizing toner, a non-decolorizing toner (normal toner), a decorative toner, and the like. The decolorizing toner has a characteristic of performing decolorization by external stimuli. The decolorization means that an image formed in a color different from a background color of paper (including not only a chromatic color but also an achromatic color such as white and black) becomes invisible to the eyes. For example, the external stimuli can be a temperature, light of a specific wavelength, and pressure. In the exemplary embodiment, the decolorizing toner performs the decolorization when its temperature becomes higher than a specific decolorizing temperature. Further, the decolorizing toner develops a color when its temperature becomes equal to or lower than a specific restoration temperature after decolorization.

Any toner may be used as the decolorizing toner as long as the toner has the characteristics described above. For example, a leuco dye may be used as a colorant of the decolorizing toner. The decolorizing toner may be appropriately combined with a developer, a decolorizing agent, a discoloring temperature adjusting agent, and the like.

The sheet storage part 140 stores a sheet used for image formation in the printer 130.

The image reading part 200 reads image information which is an object to be read as light and darkness of light. The image reading part 200 records the read image information. The recorded image information may be transmitted to another information processing apparatus via a network. The recorded image information may be formed as an image on the sheet by the printer 130.

Figure 2:
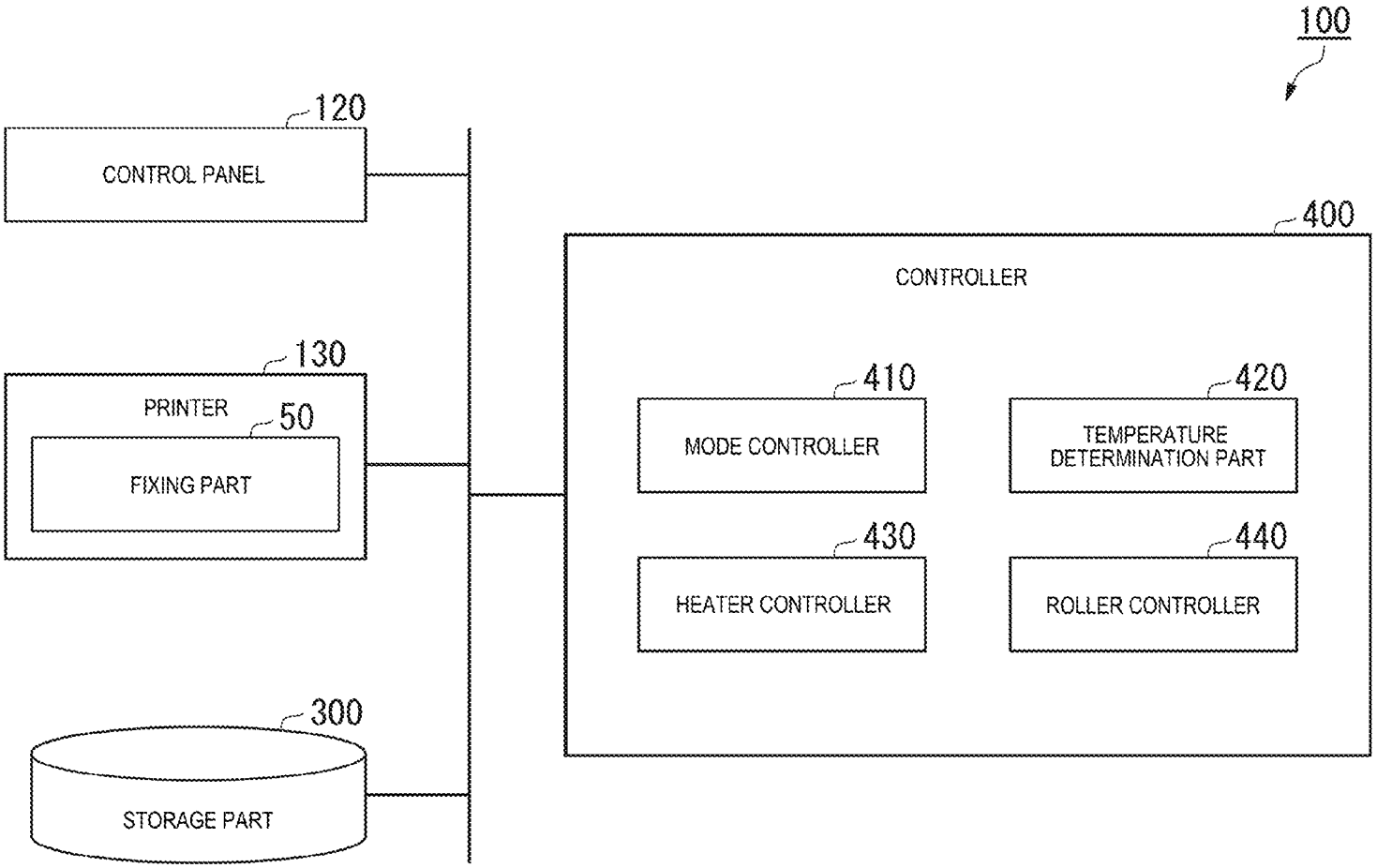
FIG. 2 is a block diagram illustrating a function of the image forming apparatus.

FIG. 2 is a block diagram illustrating a function of the image forming apparatus 100 according to an exemplary embodiment. The image forming apparatus 100 includes the control panel 120, the printer 130, a storage part 300, and a controller 400. Further, the description of the control panel 120, which is already described in FIG. 1, is omitted.

The printer 130 includes a fixing part 50. The fixing part 50 fixes a toner on the sheet by heating the sheet at a fixing temperature, and decolorizes the toner fixed on the sheet by heating the sheet at a decolorizing temperature. The fixing part 50 will be described with reference to FIG. 3.

Figure 3:
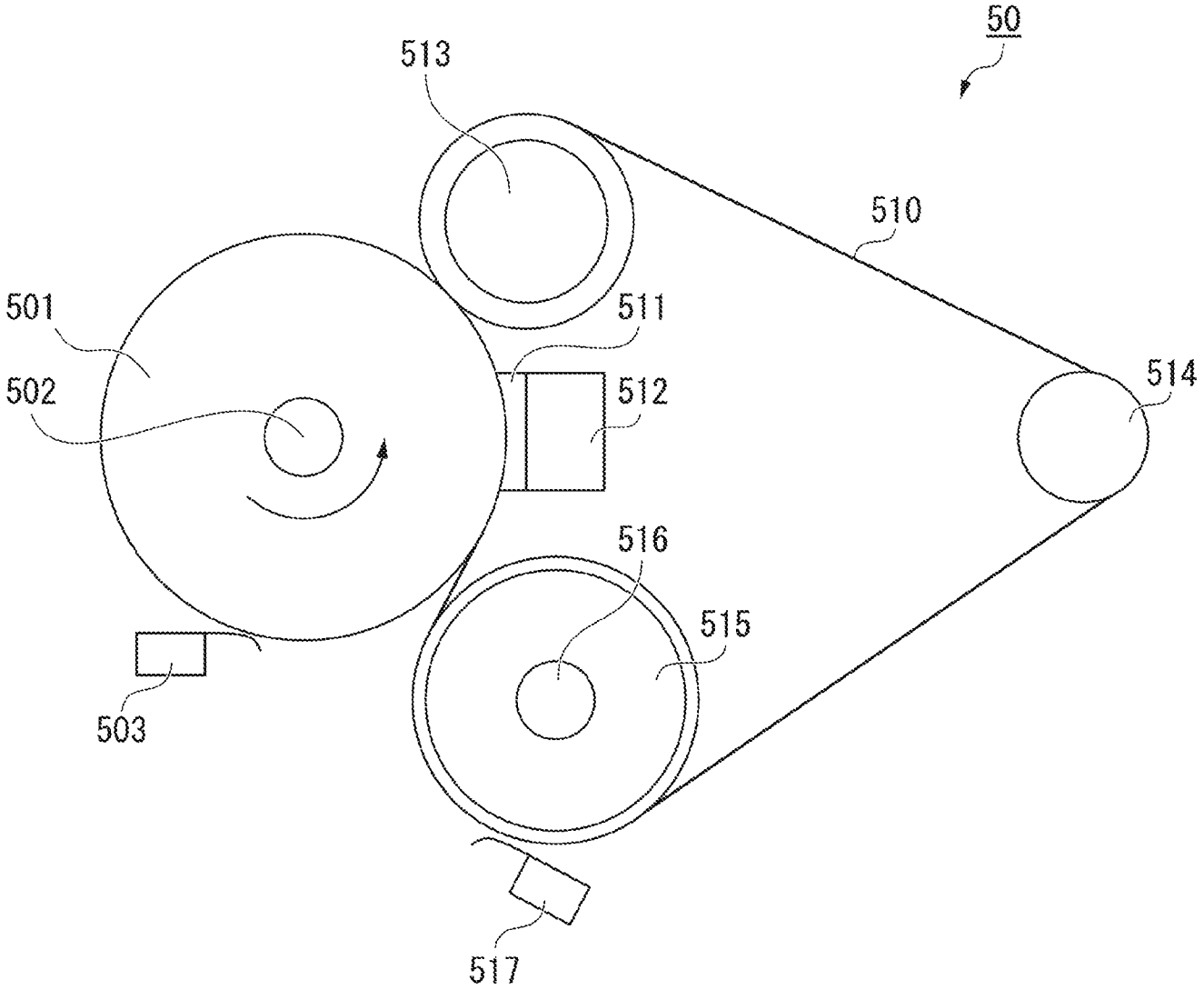
FIG. 3 is a schematic diagram illustrating a configuration example of a fixing part provided in a printer.

FIG. 3 is a schematic diagram illustrating a configuration example of the fixing part 50 provided in the printer 130 according to an exemplary embodiment. The fixing part 50 is provided with a heat roller 501, an HR lamp 502, an HR thermistor 503, a pressurizing belt 510, a pressurizing pad 511, a pad holder 512, a pressurizing roller 513, a tension roller 514, a belt heat roller 515, a pressurizing belt lamp 516, a pressurizing thermistor 517, and a cooling part (not shown).

The heat roller 501 is a fixing member formed in a cylindrical shape. The heat roller 501 heats the sheet to fix or decolorize the image transferred onto the sheet. For example, the heat roller 501 is formed in a cylindrical shape. For example, the heat roller 501 is provided with the HR lamp 502 inside. The HR lamp 502 is provided inside the heat roller 501. The HR lamp 502 heats the heat roller 501 by generating the heat.

The HR thermistor 503 measures a surface temperature of the heat roller 501. The surface temperature of the heat roller 501 measured by the HR thermistor 503 is approximately the same as a temperature of a fixing nip part which will be described later. Therefore, in the exemplary embodiment, the temperature of the fixing part 50 is set as the temperature measured by the HR thermistor 503. However, if the temperature of the fixing part 50 is a temperature reflecting the temperature of the nip part, the temperature of the fixing part 50 may be a temperature acquired by any measurement method.

The pressurizing belt 510 is held by the pressurizing roller 513, the tension roller 514, and the belt heat roller 515. The pressurizing belt 510 is pressurized to the heat roller 501 and then comes into contact therewith by the pressurizing pad 511, the pressurizing roller 513, and the belt heat roller 515. The fixing nip part is formed between the pressurizing belt 510 and the heat roller 501 by the pressurizing contact.

The pressurizing pad 511 is held in a state of being pressurized to the heat roller 501 and then coming into contact therewith through the pressurizing belt 510. The pressurizing pad 511 clamps the pressurizing belt 510 and pressurizes the pressurizing belt 510 to the heat roller 501 and then the pressurizing belt 510 contacts the heat roller 501. The pad holder 512 pressurizes the pressurizing pad 511 to the heat roller 501 and then the pressurizing pad 511 contacts the heat roller 501.

The pressurizing roller 513 is disposed downstream in a conveyance direction of the sheet. The pressure roller 513 pressurizes the pressurizing belt 510 to the heat roller 501 and then the pressurizing belt 510 contacts the heat roller 501. An outlet of the fixing nip part is formed by the pressurizing roller 513.

The tension roller 514 is disposed at a position apart from the pressurizing roller 513 and the belt heat roller 515, thereby applying tension to the pressurizing belt 510. The belt heat roller 515 is disposed upstream in the conveyance direction of the sheet. The belt heat roller 515 is formed in a hollow cylindrical shape.

The pressurizing belt lamp 516 is provided inside the belt heat roller 515. The pressurizing belt lamp 516 heats the belt heat roller 515 by generating heat. The pressurizing belt lamp 516 is configured, for example, by using a halogen lamp. The pressurizing thermistor 517 measures a surface temperature of the pressurizing belt 510 in a vicinity of the belt heat roller 515. Further, the fixing part 50 described above is one example, and in the exemplary embodiment, the fixing part 50 may be configured to be provided with at least the heat roller 501 and the pressurizing roller 513.

Referring back to FIG. 2, the storage part 300 is configured by using a storage apparatus such as a magnetic hard disk apparatus, a semiconductor storage apparatus, and the like. The storage part 300 stores a program for operating the image forming apparatus 100 representing mode setting of operation (hereinafter referred to as an operation mode) in advance. For example, in the exemplary embodiment, three processes of decolorization, decolorizing printing, and normal printing are set as the operation mode performed by the image forming apparatus 100. For example, the storage part 300 stores the program for operating the decolorization, the decolorizing printing, and the normal printing.

Further, the storage part 300 stores a threshold value of a predetermined temperature (hereinafter referred to as a temperature threshold value) with respect to the fixing part 50. The temperature threshold value is a predetermined threshold value set for each operation mode. The temperature threshold value will be described later in FIG. 5.

The controller 400 is configured by using a processor such as a CPU (Central Processing Unit), and the like. The processor executes a program, such that the controller 400 functions as a mode controller 410, a temperature determination part 420, a heater controller 430, and a roller controller 440.

The mode controller 410 controls the operation mode such as the decolorizing printing, the normal printing, decolorization, and the like. The mode controller 410 operates the image forming apparatus 100 in an operation mode received from a user. For example, the mode controller 410 reads a program of the operation mode from the storage part 300, thereby causing the image forming apparatus 100 to execute the program. Further, selection of the operation mode may be received by the control panel 120 or may be received from an external apparatus via a network, and the like.

The temperature determination part 420 determines whether or not a selected operation mode is executable temperature based upon the temperature of the fixing part 50 acquired from the HR thermistor 503. First, the temperature determination part 420 acquires a predetermined temperature threshold value in each operation mode. Next, the temperature determination part 420 acquires a temperature of the heat roller 501 (hereinafter referred to as a fixing part temperature) from the HR thermistor 503. The temperature determination part 420 determines whether or not the selected operation mode is executable temperature based upon the temperature threshold value and the fixing part temperature. The determination processing of the temperature determination part 420 is described with reference to FIG. 5 which will be described later.

The heater controller 430 controls a heater based upon a determination result of the temperature determination part 420. When it is determined that the fixing part temperature is lower than or equal to the predetermined temperature threshold value, the heater controller 430 causes the HR lamp 502 to generate heat. When it is determined that the fixing part temperature is higher than the predetermined temperature threshold value, the heater controller 430 stops the heat generation of the HR lamp 502.

The roller controller 440 controls a roller based upon an operation mode selected by the mode controller 410. When it is determined that the selected operation mode is not executable, the heater controller 430 rotates the fixing part 50 at a speed higher than a normal rotation speed. When warming the fixing part 50 by rotating the fixing part 50 at a high speed, the temperature of the fixing part 50 can be quickly uniformized. Further, when the fixing part 50 is cooled by rotating the fixing part 50 at a high speed, the temperature of the fixing part 50 can be quickly lowered by heat radiation during the rotation.

Figure 4:
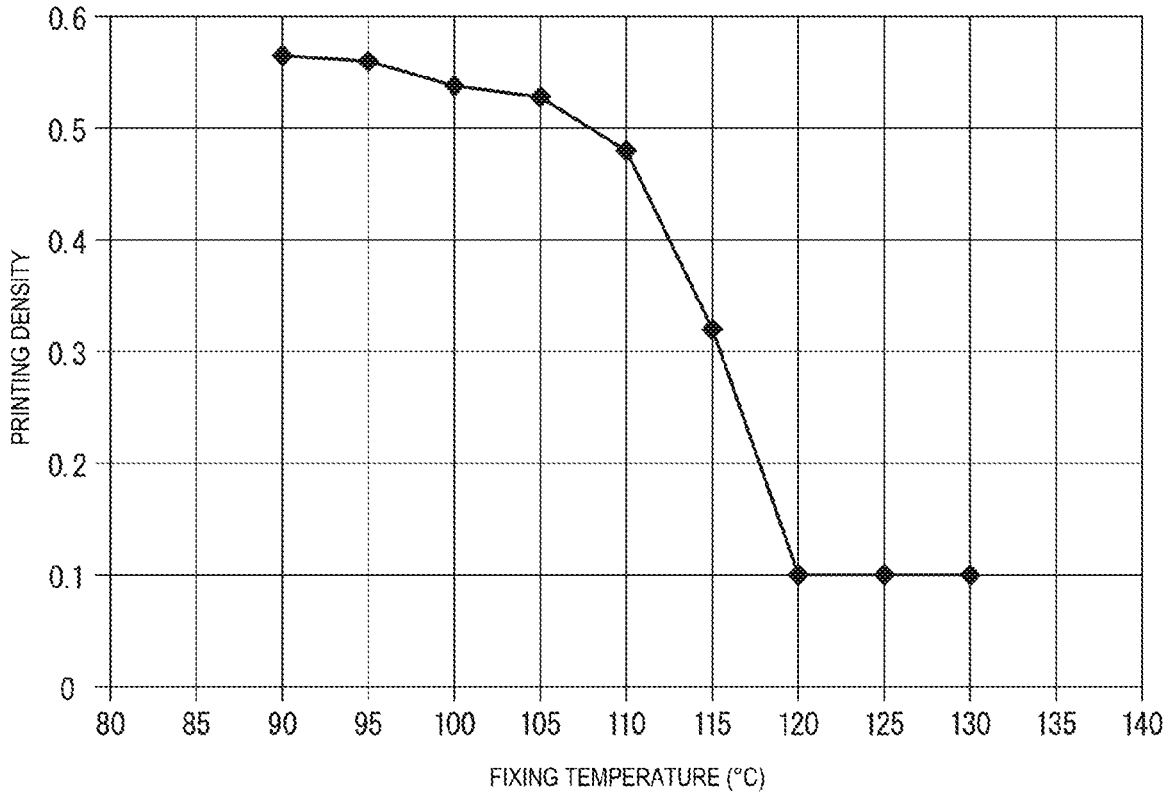
FIG. 4 is a graph illustrating a relationship between printing density of a decolorizing toner and a fixing temperature.

FIG. 4 is a graph illustrating a relationship between printing density of the decolorizing toner and the fixing temperature according to an exemplary embodiment. The printing density of the decolorizing toner varies from printing density, in which visualization can be performed, to printing density, in which visualization cannot be performed, by the fixing temperature of the fixing part 50 during the printing. In FIG. 4, a temperature threshold value at which printing density of the non-decolorizing toner starts to decrease is described as 99° C.

The decolorizing toner has a characteristic of performing heat decolorization when exceeding a predetermined temperature threshold value after the decolorizing toner is heated and fixed to the sheet. Therefore, when the fixing temperature exceeds 99° C. and the decolorizing printing is performed, the printing is performed at the printing density in which visualization cannot be performed. In FIG. 4, when the fixing part temperature exceeds the temperature threshold value of 99° C. and approaches 105° C., the printing density starts to deteriorate due to the image decolorization. Thereafter, when the fixing part temperature exceeds 120° C., an image printed by the decolorizing toner is completely decolorized. In the exemplary embodiment, a standard fixing temperature when performing the decolorizing printing is 99° C.

Figure 5:
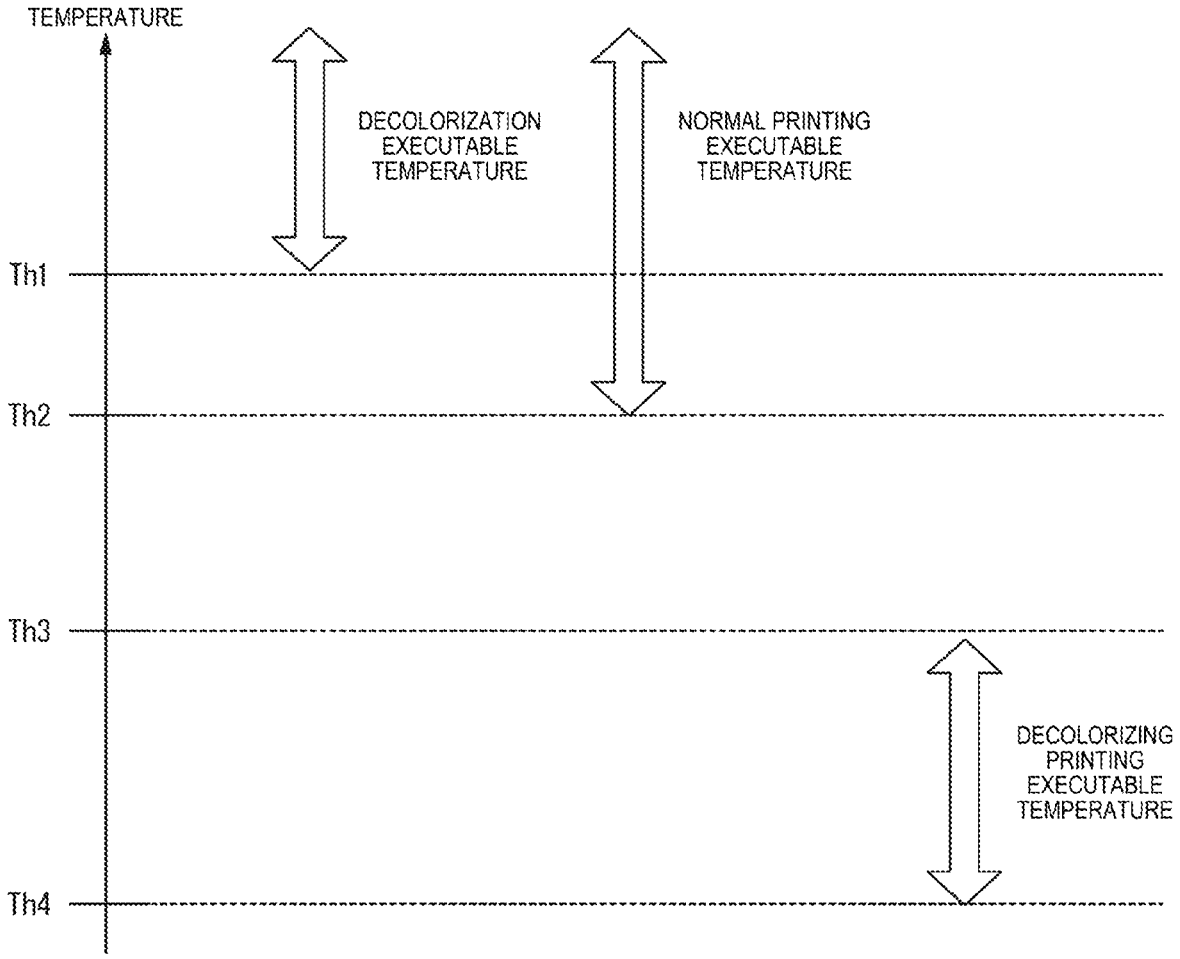
FIG. 5 is a specific example illustrating a temperature threshold value of each operation mode.

FIG. 5 is a specific example illustrating a temperature threshold value of each operation mode according to an exemplary embodiment. FIG. 5 illustrates temperature threshold values of the decolorizing printing, the normal printing, and the decolorization as an example of the operation mode of the exemplary embodiment. Hereinafter, the processing of the temperature determination part 420 and the temperature threshold value in each operation mode will be described.

Decolorization

When the selected operation mode is the decolorization, the temperature determination part 420 acquires a predetermined temperature threshold value Th1 in the decolorization. The temperature threshold value Th1 is a lower limit temperature for performing the decolorization. For example, the temperature threshold value Th1 of the decolorization indicates a case in which the fixing part temperature becomes 120° C.

When the fixing part temperature is higher than the predetermined temperature threshold value Th1, the temperature determination part 420 determines that the fixing part temperature is a temperature at which the decolorization is executable. When the fixing part temperature is equal to or lower than the predetermined temperature threshold value Th1, the temperature determination part 420 determines that the fixing part temperature is a temperature at which the decolorization is not executable and sends a determination result to the heater controller 430 and the roller controller 440.

Normal Printing

When the selected operation mode is the normal printing, the temperature determination part 420 acquires a predetermined temperature threshold value Th2 in the normal printing. The temperature threshold value Th2 is a lower limit temperature for the normal printing. For example, the temperature threshold value Th2 in the normal printing indicates a case in which the fixing part temperature becomes 115° C.

When the fixing part temperature is higher than the predetermined temperature threshold value Th2, the temperature determination part 420 determines that the fixing part temperature is a temperature at which the normal printing is executable. When the fixing part temperature is equal to or lower than the predetermined temperature threshold value Th2, the temperature determination part 420 determines that the fixing part temperature is a temperature at which the normal printing is not executable and sends a determination result to the heater controller 430 and the roller controller 440.

Decolorizing Printing

A temperature threshold value in the decolorizing printing is lower than the temperature threshold value in the normal printing. Further, the decolorizing toner is decolorized when the fixing part temperature is high. Therefore, in consideration of the fixing temperature in the decolorizing printing, two values of an upper limit and a lower limit are required as the temperature threshold value.

When the selected operation mode is the decolorizing printing, the temperature determination part 420 acquires a predetermined temperature threshold value Th3 and a predetermined temperature threshold value Th4 in the decolorizing printing. The temperature threshold value Th3 is an upper limit for performing the decolorizing printing. The temperature threshold value Th4 is a lower limit for performing the decolorizing printing. For example, the temperature threshold value Th3 in the decolorizing printing indicates a case in which the fixing part temperature becomes 105° C. For example, the temperature threshold value Th4 in the decolorizing printing indicates a case that the fixing part temperature becomes 99° C.

When the fixing part temperature is within a range from the lower limit Th4 to the upper limit Th3 of the temperature threshold value, the temperature determination part 420 determines that the fixing part temperature is a temperature at which the decolorizing printing is executable. When the fixing part temperature is equal to or lower than the temperature threshold value Th4, the temperature determination part 420 determines that the fixing part temperature is a temperature at which the decolorizing printing is not executable and sends a determination result to the heater controller 430 and the roller controller 440. When the fixing part temperature is higher than the temperature threshold value Th3, the temperature determination part 420 determines that the fixing part temperature is a temperature at which the decolorizing printing is not executable and sends a determination result to the heater controller 430 and the roller controller 440.

Figure 6:
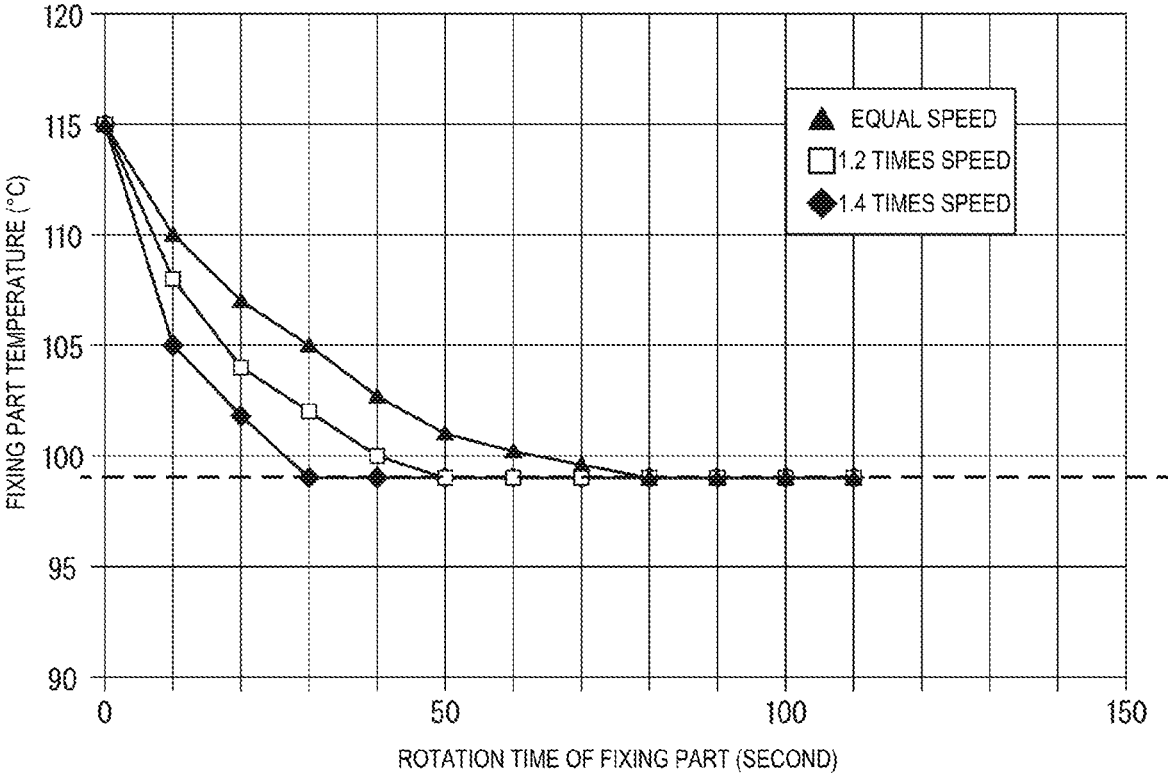
FIG. 6 is a graph illustrating a relationship between a rotation time of a fixing part and a temperature of the fixing part.

FIG. 6 is a graph illustrating a relationship between a rotation time of the fixing part and the temperature of the fixing part according to an exemplary embodiment. As an example, FIG. 6 represents a time descending from a fixing temperature (115° C.) at which the decolorizing printing cannot be executed by the fixing part temperature to a fixing temperature (99° C.) at which the decolorizing printing can be executed by the fixing part temperature.

In FIG. 6, for example, when the fixing part 50 is rotated at an equal speed, a waiting time from 115° C. to 99° C. is about 80 seconds. For example, when the fixing part 50 is rotated at 1.2 times speed, the waiting time from 115° C. to 99° C. is about 45 seconds. Further, for example, when the fixing part 50 is rotated at 1.4 times speed, the waiting time from 115° C. to 99° C. is about 30 seconds. As described above, it is possible not only to increase the heat radiation effect, but also to efficiently lower the fixing part temperature by rotating the fixing part 50 at a high speed.

Figure 7:
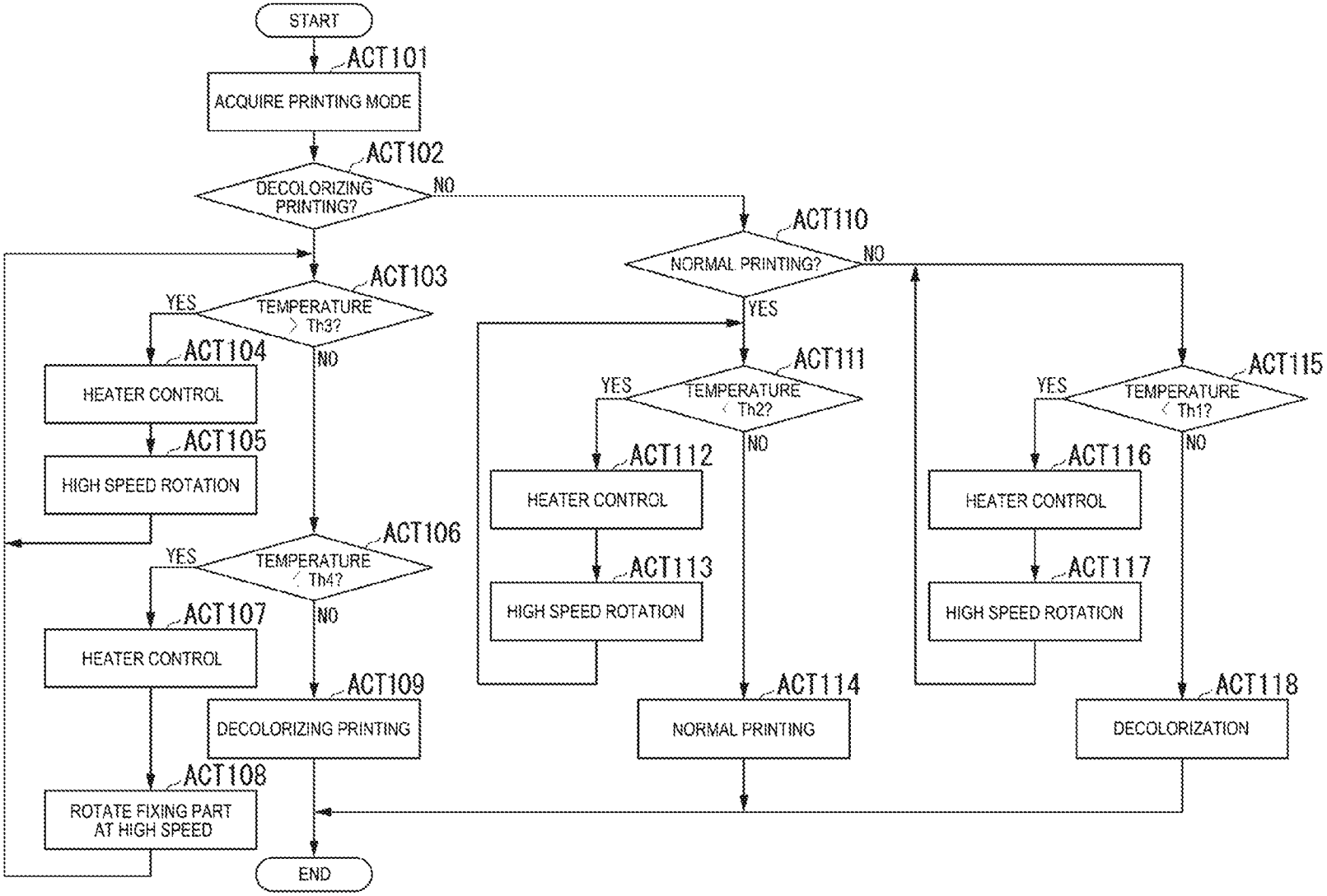
FIG. 7 is a flow chart illustrating a flow of printing of the image forming apparatus.

FIG. 7 is a flow chart illustrating a flow of printing of the image forming apparatus 100 according to an exemplary embodiment.

The image forming apparatus 100 receives selection of an operation mode from a user through the control panel 120 and the network (ACT101). The mode controller 410 determines whether or not the operation mode received from the user is the decolorizing printing (ACT102).

When the operation mode is the decolorizing printing (ACT102—YES), the temperature determination part 420 determines whether or not the temperature of the fixing part 50 is higher than Th3 (ACT103). When the operation mode is not the decolorizing printing (ACT102—NO), it is determined whether or not the operation mode is the normal printing (ACT110). When the temperature of the fixing part 50 is higher than Th3 (ACT103—YES), the heater controller 430 stops the heat generation of the fixing part 50 (ACT104). Further, when the heat generation of the fixing part 50 is already stopped, the heater controller 430 transfers the process to ACT105 as it is without performing any process. The roller controller 440 rotates the fixing part 50 at a speed higher than the normal rotation speed (ACT105).

When the temperature of the fixing part 50 is lower than Th3 (ACT103—NO), the temperature determination part 420 determines whether or not the temperature of the fixing part 50 is lower than Th4 (ACT106). When the temperature of the fixing part 50 is lower than Th4 (ACT106—YES), the heater controller 430 causes the fixing part 50 to generate heat (ACT107). Further, when the fixing part 50 already generated heat, the heater controller 430 transfers the process to ACT108 as it is without performing any process. The roller controller 440 rotates the fixing part 50 at a speed higher than the normal rotation speed (ACT108). When the temperature of the fixing part 50 is higher than Th4 (ACT106—NO), the decolorizing printing is executed (ACT109).

Next, when the operation mode is the normal printing (ACT110—YES), the temperature determination part 420 determines whether or not the temperature of the fixing part 50 is lower than Th2 (ACT111). When the temperature of the fixing part 50 is lower than Th2 (ACT111—YES), the heater controller 430 causes the fixing part 50 to generate the heat (ACT112). When the fixing part 50 already generated the heat, the heater controller 430 transfers the process to ACT113 as it is without performing any process. The roller controller 440 rotates the fixing part 50 at a speed higher than the normal rotation speed (ACT113). When the temperature of the fixing part 50 is higher than Th2 (ACT111—NO), the normal printing is executed (ACT114).

Next, when the operation mode is not the normal printing (ACT110—NO), the temperature determination part 420 determines whether or not the temperature of the fixing part 50 is lower than Th1 in order to perform the decolorization (ACT115). When the temperature of the fixing part 50 is lower than Th1 (ACT115—YES), the heater controller 430 causes the fixing part 50 to generate the heat (ACT116). When the fixing part 50 already generated the heat, the heater controller 430 transfers the process to ACT117 as it is without performing any process. The roller controller 440 rotates the fixing part 50 at a speed higher than the normal rotation speed (ACT117). When the temperature of the fixing part 50 is higher than Th1 (ACT115—NO), the decolorization is executed (ACT118).

According to the image forming apparatus 100 of the exemplary embodiments configured as described above, the waiting time until the fixing part 50 reaches the predetermined temperature can be reduced by rotating the fixing part 50 at a high speed. When the temperature of the fixing part 50 is lowered, heat can be efficiently radiated by rotating the fixing part 50 at the high speed, thereby reducing the waiting time. When the temperature of the fixing part 50 is raised, the temperature thereof can be efficiently uniformized by rotating the fixing part 50 at the high speed, thereby reducing the waiting time.

Modifications

In the operation modes of the decolorization and the normal printing, high-speed rotation may not be performed, and the high-speed rotation may be performed only in the operation mode of the decolorizing printing. The high-speed rotation may be performed in the operation mode of the decolorizing printing, and in the operation mode of at least one of the decolorization and the normal printing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a fixing roller configured to convey a sheet by rotation and to fix a recording material formed on the sheet to the sheet;

a heater configured to heat the fixing roller;

a heater controller configured to control a temperature of the heater;

a roller controller configured to control a rotation speed of the fixing roller, wherein when a fixing part temperature indicating a temperature of the fixing roller satisfies a predetermined condition indicating that the fixing roller is not suitable for an operation, the roller controller increases a rotation speed to be higher than a rotation speed in a case in which the fixing part temperature does not satisfy the predetermined condition;

a temperature determination part configured to determine whether or not an operation mode received from a user is executable based upon the fixing part temperature, wherein the heater controller controls the temperature of the heater based upon a determination result of the temperature determination part, and wherein the roller controller controls the rotation speed of the fixing roller based upon a determination result of the temperature determination part.

2. The apparatus according to claim 1, wherein the operation mode includes normal printing indicating a printing mode using a normal toner; decolorizing printing indicating a printing mode using a toner capable of performing decolorization; and decolorization indicating a mode decolorizing a decolorizing toner.

3. The apparatus according to claim 2, wherein when the operation mode is the decolorization, the temperature determination part acquires a temperature threshold value indicating a threshold value of a lower limit of a predetermined temperature in the decolorization, and determines whether or not the decolorization is executable based upon the fixing part temperature and the first temperature threshold value.

4. The apparatus according to claim 2, wherein when the operation mode is the normal printing, the temperature determination part acquires a temperature threshold value indicating a threshold value of a lower limit of a predetermined temperature in the normal printing, and determines whether or not the normal printing is executable based upon the fixing part temperature and the temperature threshold value.

5. The apparatus according to claim 2, wherein when the operation mode is the decolorizing printing, the temperature determination part acquires a first temperature threshold value indicating a threshold value of an upper limit of a predetermined temperature in the decolorizing printing and a second temperature threshold value indicating a threshold value of a lower limit of the predetermined temperature in the decolorizing printing, and determines whether or not the decolorizing printing is executable based upon the fixing part temperature, the first temperature threshold value, and the second temperature threshold value.

6. The apparatus according to claim 5, wherein when the fixing part temperature exceeds the first temperature threshold value of the operation mode, the heater controller stops the heater from generating heat; when the fixing part temperature exceeds the second temperature threshold value of the operation mode, the heater controller causes the heater to generate heat; and the roller controller increases the rotation speed of the fixing part.

7. The apparatus according to claim 2, wherein when the fixing part temperature is equal to or lower than a temperature threshold value of a lower limit of the operation mode, the heater controller causes the fixing roller to generate heat.

8. The apparatus according to claim 2, wherein when the fixing part temperature does not satisfy a condition of a temperature threshold value of the operation mode, the roller controller increases the rotation speed of the fixing roller higher than a predetermined rotation speed.

9. An image forming method, comprising:

controlling a temperature of a heater heating a fixing roller that is configured to convey a sheet by rotation and to fix a recording material formed on the sheet to the sheet wherein controlling the temperature of the heater comprises:

determining, with a temperature determination part, whether or not an operation mode received from a user is executable based upon the fixing part temperature, wherein a heater controller controls the temperature of the heater based upon a determination result of the temperature determination part, and a roller controller controls the rotation speed of the fixing roller based upon a determination result of the temperature determination part;

controlling a rotation speed of the fixing roller; and when a fixing part temperature indicating a temperature of the fixing roller satisfies a predetermined condition indicating that the fixing roller is not suitable for an operation, increasing a rotation speed to be higher than a rotation speed in a case in which the fixing part temperature does not satisfy the predetermined condition.

10. A method for applying two or more types of toners in a printing device, the method comprising:

heating a fixing roller to a first temperature, the first temperature sufficient to affect a first type of toner;

rotating the fixing roller at a first speed at the first temperature to affect the first type of toner; and cooling the fixing roller to a second temperature sufficient to affect a second type of toner; wherein cooling the fixing roller comprises increasing a rotation speed of the fixing roller from the first speed to a second speed, the fixing roller in contact with a pressurizing belt conducting heat away from the fixing roller at a faster rate corresponding to the second speed than a rate corresponding to the first speed.

11. The method of claim 10, wherein heating the fixing roller to the first temperature comprises heating the fixing roller to about 120 degrees Celsius to decolorize the first type of toner on a printed medium, the first type of toner being a decolorizing toner.

12. The method of claim 11, wherein heating the fixing roller to the second temperature comprises heating the fixing roller to about 115 degrees Celsius to fix the second type of toner onto a print medium, the second type of toner being a normal printing toner.

13. The method of claim 10, wherein heating the fixing roller to the first temperature comprises heating the fixing roller to about 115 degrees Celsius to fix the first type of toner onto a print medium, the first type of toner being a normal printing toner.

14. The method of claim 13, wherein heating the fixing roller to the second temperature comprises heating the fixing roller to about 99 degrees Celsius to fix the second type of toner onto a print medium, the second type of toner being a decolorizing toner subject to decolorization at about 120 degrees Celsius.

15. The method of claim 10, further comprising heating the fixing roller to a third temperature, the third temperature sufficient to affect the second type of toner at the first speed.

16. The method of claim 15, wherein the first temperature is about 115 degrees Celsius, the second temperature is between 99 and 105 degrees Celsius, and the third temperature is about 120 degrees Celsius, and wherein the first type of toner is a normal printing toner and the second type of toner is a decolorizing toner.

17. The method of claim 10, wherein the pressurizing belt includes a heater for raising temperature of the pressurizing belt and the fixing roller.

18. The method of claim 17, further comprising heating the fixing roller to a third temperature partially by heating the pressurizing belt and increasing the rotation speed of the fixing roller to the second speed.

* * * * *